US012553342B2

(12) United States Patent
Helsel

(10) Patent No.: US 12,553,342 B2
(45) Date of Patent: Feb. 17, 2026

(54) CUTTER TOOTH ASSEMBLY FOR AN EXCAVATING TOOL

(71) Applicant: Kennametal Inc., Latrobe, PA (US)

(72) Inventor: Eric Helsel, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 811 days.

(21) Appl. No.: 17/879,132

(22) Filed: Aug. 2, 2022

(65) Prior Publication Data

US 2024/0044249 A1 Feb. 8, 2024

(51) Int. Cl.
*E21C 35/18* (2006.01)
*E02F 9/28* (2006.01)

(52) U.S. Cl.
CPC ..... *E21C 35/18* (2013.01); *E02F 9/2808* (2013.01)

(58) Field of Classification Search
CPC ..... B28D 1/186; B28D 1/188; E21C 35/1831; E21C 35/1837; E21C 35/19; E21C 35/1936; E21C 35/18; E02F 9/2816; E02F 9/2825; E02F 9/2875; E02F 9/2883; E02F 9/2833; E02F 9/2808; E02F 9/2858; E02F 9/2866
See application file for complete search history.

(56) References Cited

U.S. PATENT DOCUMENTS 1,544,222 A * 6/1925 Crosby ..... E02F 9/2816 37/455
1,775,984 A * 9/1930 Younie ..... E02F 9/2833 279/97
1,816,710 A * 7/1931 Young ..... E02F 9/2825 37/454
2,319,464 A * 5/1943 Massa ..... E02F 9/2816 37/91
2,610,049 A * 9/1952 Fulke ..... E21C 35/1933 175/383
2,971,280 A * 2/1961 Smedley ..... E02F 9/2816 D15/29
2,976,028 A * 3/1961 Saxman ..... E21C 35/19 299/108
3,073,582 A * 1/1963 Delli-Gatti, Jr. ..... E21C 35/19 37/456

(Continued)

FOREIGN PATENT DOCUMENTS

BE 876196 A * 9/1979 ..... B28D 1/188
EP 1780375 B1 2/2008

(Continued)

*Primary Examiner* — Adam J Behrens
(74) *Attorney, Agent, or Firm* — Christopher J. Owens

(57) ABSTRACT

A cutter tooth assembly includes a cutter tooth having a shank portion and a cutting portion, and a cutter tooth holder having a pocket for receiving at least a portion of the shank portion of the cutter tooth. The shank portion of the cutter tooth has a plurality of tapered surfaces formed at a first angle with respect to a vertical axis of the cutter tooth, and the pocket of the cutter tooth holder has a plurality of tapered surfaces formed at a second angle with respect to a vertical axis of the cutter tooth holder that cooperate with the plurality of tapered surfaces of the shank portion of the cutter tooth to minimize tolerances between the shank portion of the cutter tooth and the pocket of the cutter tooth holder during wear of the cutter tooth assembly.

12 Claims, 12 Drawing Sheets

(56) References Cited

U.S. PATENT DOCUMENTS

| | | | | | |
|---|---|---|---|---|---|
| 3,275,376 | A * | 9/1966 | Prox, Jr. | E21C 35/19 | 279/19.5 |
| 3,737,199 | A * | 6/1973 | Stephenson | E02F 3/188 | 172/123 |
| 4,006,936 | A * | 2/1977 | Crabiel | E02F 9/2866 | 299/108 |
| 4,057,294 | A * | 11/1977 | Krekeler | E02F 9/2866 | 82/158 |
| 4,360,981 | A * | 11/1982 | Bierwith | E02F 3/241 | 37/457 |
| 4,609,227 | A * | 9/1986 | Wild | E21C 35/1936 | 299/108 |
| 4,642,920 | A * | 2/1987 | Lehnhoff | E02F 9/2858 | 37/452 |
| 4,835,888 | A * | 6/1989 | Hemphill | E02F 9/2825 | 37/457 |
| 4,998,574 | A | 3/1991 | Beach et al. | | |
| 5,016,943 | A * | 5/1991 | Wirtgen | B28D 1/188 | 299/87.1 |
| 6,270,164 | B1 | 8/2001 | Seitle et al. | | |
| 6,270,165 | B1 | 8/2001 | Peay | | |
| 6,450,269 | B1 | 9/2002 | Wentworth et al. | | |
| 7,578,080 | B2 | 8/2009 | Stoetzer et al. | | |
| 8,051,588 | B2 | 11/2011 | Ruby | | |
| 8,430,009 | B2 | 4/2013 | Micacchi | | |
| 8,534,766 | B2 | 9/2013 | Ritchey et al. | | |
| 9,303,511 | B2 | 4/2016 | Paros et al. | | |
| 9,657,462 | B2 * | 5/2017 | Quarfordt | E02F 9/2825 | |
| 9,890,635 | B2 | 2/2018 | Latham | | |
| 10,024,035 | B2 * | 7/2018 | Triginer Boixeda | E02F 9/2825 | |
| 10,590,632 | B2 | 3/2020 | Parzynski et al. | | |
| 10,648,330 | B1 * | 5/2020 | Weaver | E21C 35/1833 | |
| 10,676,892 | B2 | 6/2020 | Makela | | |
| 2007/0107273 | A1 | 5/2007 | Stoetzer | | |
| 2009/0261646 | A1 | 10/2009 | Ritchey et al. | | |
| 2010/0011934 | A1 | 1/2010 | Micacchi | | |
| 2010/0205835 | A1 | 8/2010 | Ruby | | |
| 2014/0020269 | A1 | 1/2014 | Huber | | |
| 2014/0319897 | A1 | 10/2014 | Paros et al. | | |
| 2014/0319898 | A1 | 10/2014 | Paros et al. | | |
| 2014/0368022 | A1 * | 12/2014 | Torres Delgado | E21C 35/19 | 299/79.1 |
| 2015/0176408 | A1 | 6/2015 | Latham | | |
| 2016/0281502 | A1 * | 9/2016 | Chiang | E21C 35/18 | |
| 2016/0305242 | A1 | 10/2016 | Latham | | |
| 2017/0175365 | A1 * | 6/2017 | Triginer Boixeda | E02F 9/2825 | |
| 2018/0195255 | A1 | 7/2018 | Parzynski et al. | | |
| 2018/0313057 | A1 | 11/2018 | Makela | | |

FOREIGN PATENT DOCUMENTS

| | | | | |
|---|---|---|---|---|
| EP | 2952676 | A1 * | 12/2015 | E21C 27/36 |
| FR | 2823793 | A1 * | 10/2002 | E21C 35/19 |
| GB | 2023095 | * | 12/1979 | E02F 9/28 |
| RU | 2670306 | C1 * | 10/2018 | |
| WO | WO-9219822 | A1 * | 11/1992 | E02F 9/2825 |
| WO | WO-2019175303 | A1 * | 9/2019 | E02F 9/285 |

* cited by examiner

CUTTER TOOTH ASSEMBLY FOR AN EXCAVATING TOOL

FIELD OF THE DISCLOSURE

In general, the disclosure generally relates to an excavating tool, such as, for example, a cutter tooth assembly useful for cutting through various earth strata and other materials. More specifically, the disclosure pertains to a cutter tooth assembly comprising a cutter tooth having cutting portion and a shank portion with tapered mating surfaces that cooperate with tapered mating surfaces of a pocket of a cutter tooth holder to minimize tolerances between the shank portion of the cutter tooth and the pocket of the cutter tooth holder during wear of the cutter tooth assembly.

BACKGROUND OF THE DISCLOSURE

Various types of cutter assemblies having cutter teeth or bits are used for mining, construction and related operations. Typically, the cutter teeth include a shank for insertion into a tool holder for engagement with earth strata, for example, coal, mineral formation, or other natural materials. An individual cutting insert formed of a hard, wear resistant material is provided on the cutter teeth to cut into the earth strata and to enhance the life of the cutter teeth.

Typically, cutter tooth holders or sockets either have two sides, a center web, or no sides. A socket with two sides is very wide, and hard to clean. A socket with a center web has complex tooth design. A socket with no sides can become structurally weak, especially during weld installation of the socket, during assembly of teeth or when experience extreme cutting forces.

An example of a cutter assembly having cutter teeth that are used for mining and construction operations includes a flat cutting tool. These types of cutting tools usually include a plurality of cutter teeth mounted on a rotatable disc, rake, chain, barrel or drum, wherein each of the cutter teeth include at least one substantially flat cutting insert made of a hard material. These substantially flat cutting inserts are affixed to the insert/workpiece interface of the cutter tooth.

A conventional core barrel casing quick change tooth system is a two-part system in which a socket or cutter tooth holder is a permanent, welded part, while a cutter tooth is a consumable part that can be changed or replaced without welding. Alternatively, the cutter tooth can be welded to the socket. The cutter tooth and socket in such a conventional quick-change system do not fit snug due to tolerances of the mating surfaces between the cutting tooth and the socket, socket wear, and the like. In addition, the cutter tooth is not easily welded in the case where the cutter tooth is welded to the socket or to the barrel or drum frame due to its steel grade material or the geometry of the weld area. Further, manufacturers, distributors, and users must maintain different inventories for different styles of core barrels.

SUMMARY OF THE DISCLOSURE

The problem of lack of a snug fit between the cutter tooth and the socket is solved by providing the cutter tooth having a shank portion with a plurality of tapered surfaces that cooperate with a corresponding number of tapered surfaces of the pocket of the socket to minimize tolerances between the shank portion of the cutter tooth and the pocket of the cutter tooth holder during wear of the cutter tooth assembly.

In one aspect, a cutter tooth assembly comprises a cutter tooth having a shank portion and a cutting portion, and a cutter tooth holder having a pocket for receiving at least a portion of the shank portion of the cutter tooth. The shank portion of the cutter tooth has a plurality of tapered surfaces formed at a first angle with respect to a vertical axis of the cutter tooth, and the pocket of the cutter tooth holder has a plurality of tapered surfaces formed at a second angle with respect to a vertical axis of the cutter tooth holder that cooperate with the plurality of tapered surfaces of the shank portion of the cutter tooth to minimize tolerances between the shank portion of the cutter tooth and the pocket of the cutter tooth holder during wear of the cutter tooth assembly.

In another aspect, a cutter tooth assembly comprises a cutter tooth having a top surface, a bottom surface opposite the top surface, a shank portion and a cutting portion; and a cutter tooth holder having a top surface, a bottom surface opposite the top surface, and a pocket for receiving at least a portion of the shank portion of the cutter tooth. The shank portion of the cutter tooth has a plurality of tapered surfaces formed at a first angle with respect to a central, vertical axis of the cutter tooth such that a width of the cutter tooth is largest proximate the top surface and narrowest proximate the bottom surface. The pocket of the cutter tooth holder has a bottom wall and a plurality of tapered surfaces formed at a second angle with respect to a central, vertical axis of the cutter tooth holder such that a cross-sectional area of the pocket is largest proximate the top surface and smallest proximate the bottom wall.

BRIEF DESCRIPTION OF THE DRAWINGS

While various embodiments of the disclosure are illustrated, the particular embodiments shown should not be construed to limit the claims. It is anticipated that various changes and modifications may be made without departing from the scope of this disclosure.

DETAILED DESCRIPTION OF THE DISCLOSURE

Figure 1:
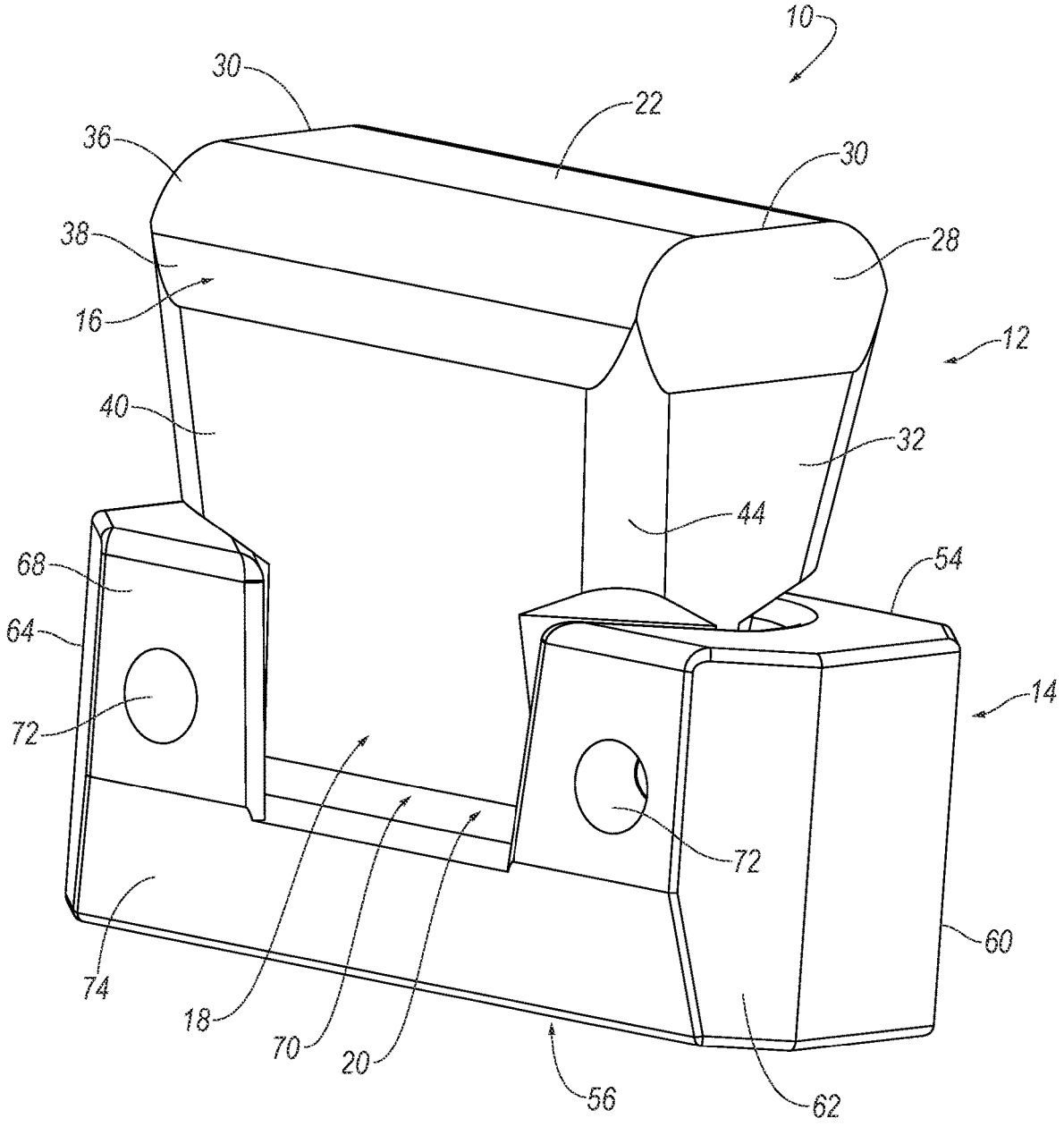
FIG. 1 is a side perspective view of a cutter tooth assembly according to an embodiment of the disclosure.
Figure 2:
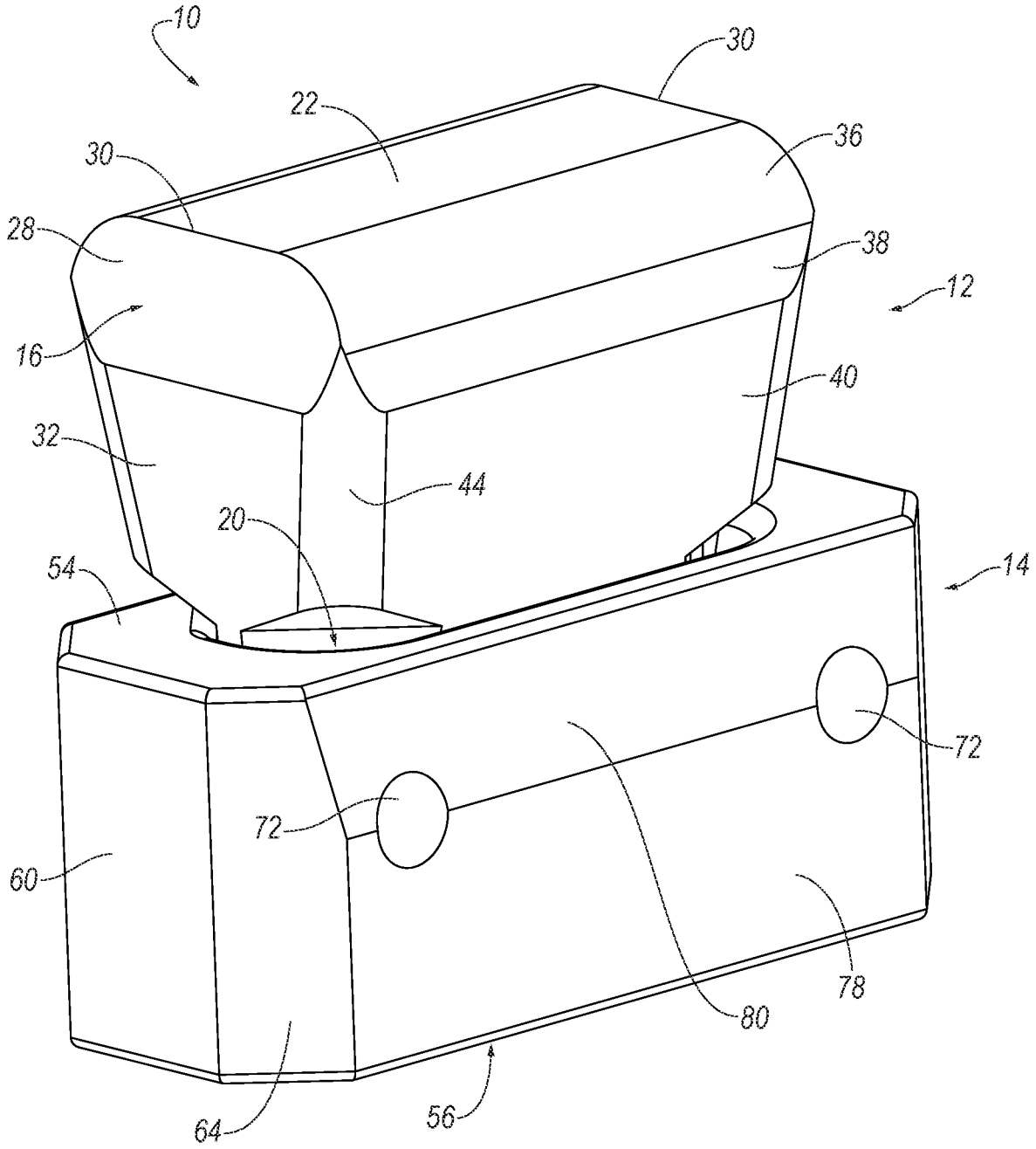
FIG. 2 is another side perspective view of the cutter tooth assembly of FIG. 1.
Figure 3:
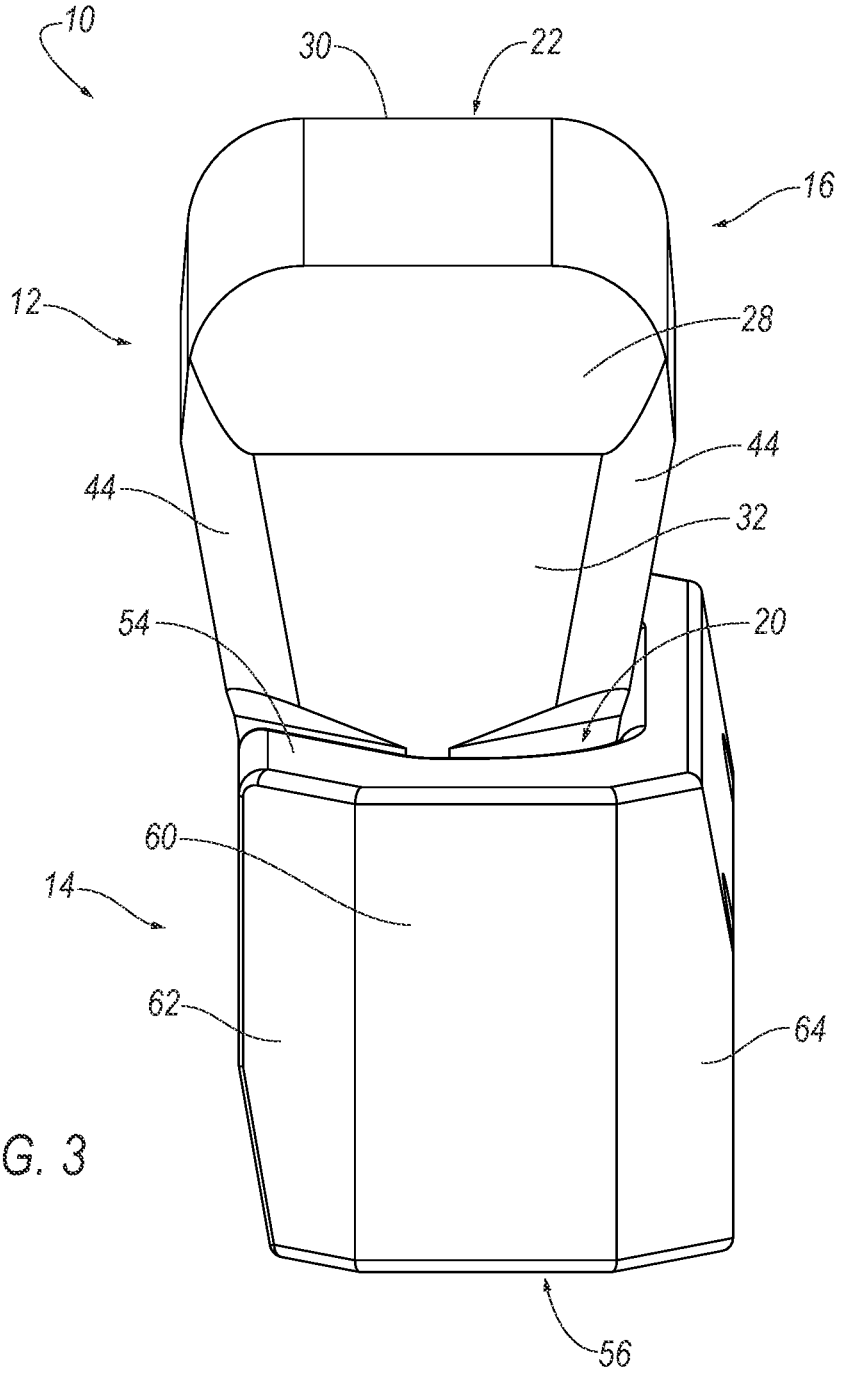
FIG. 3 is a front perspective view of the cutter tooth assembly of FIG. 1.
Figure 4:
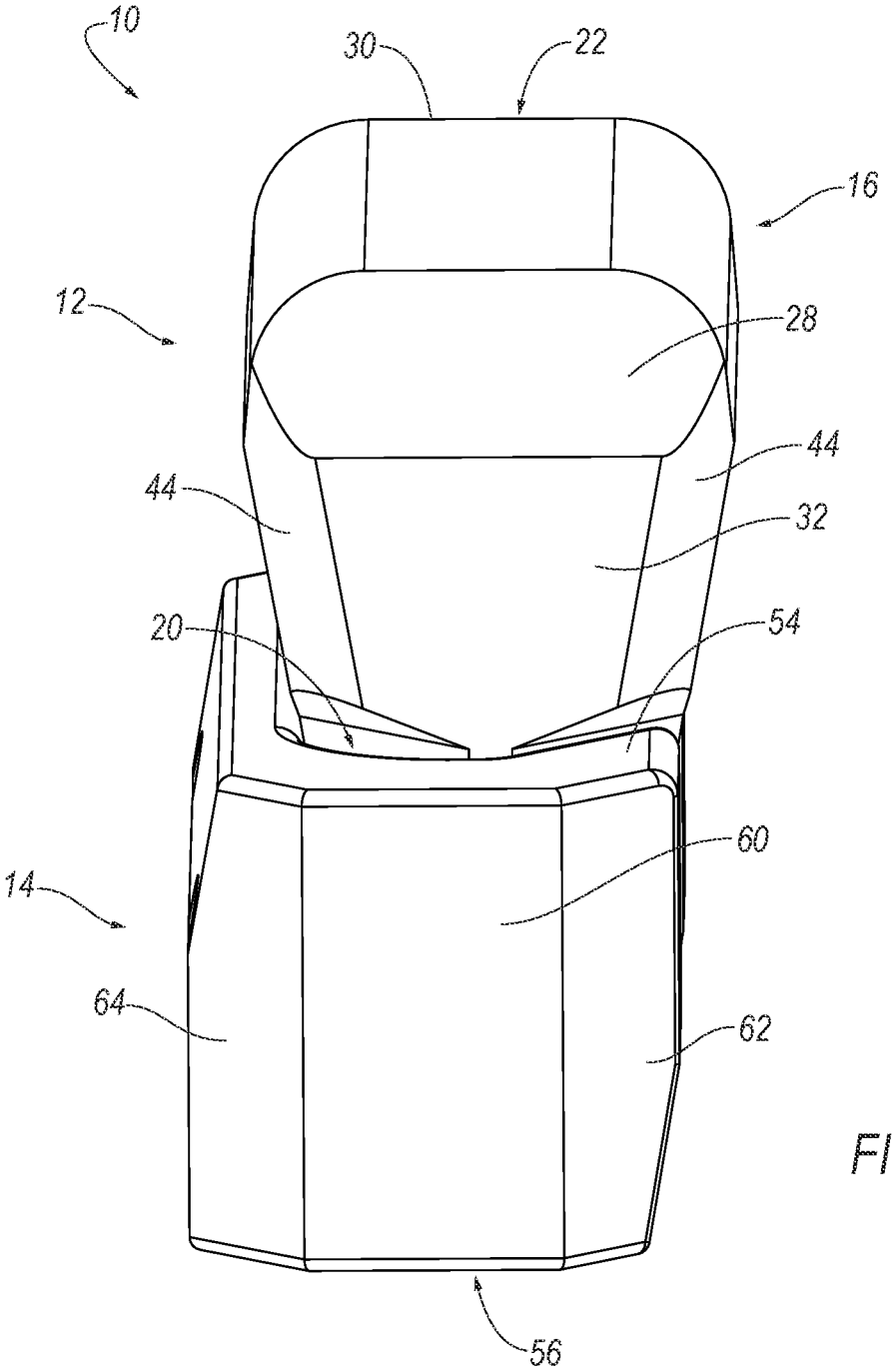
FIG. 4 is another front perspective view of the cutter tooth assembly of FIG. 1.

Referring now to FIGS. 1-4, a cutter tooth assembly 10 is shown according to an embodiment of the disclosure. In general, the cutter tooth assembly 10 comprises a cutter tooth 12 and a cutter tooth holder 14. The cutter tooth 12 has a cutting portion 16 and a shank portion 18. The cutter tooth holder 14 has a pocket 20 for receiving at least a portion of the shank portion 18 of the cutter tooth 12.

Directional phrases used herein, such as, for example, left, right, front, back, top, bottom and derivatives thereof, relate to the orientation of the elements shown in the drawings and are not limiting upon the claims unless expressly recited therein. Identical parts are provided with the same reference number in all drawings.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Throughout the text and the claims, use of the word "about" in relation to a range of values (e.g., "about 22 to 35 wt %") is intended to modify both the high and low values recited, and reflects the penumbra of variation associated with measurement, significant figures, and interchangeability, all as understood by a person having ordinary skill in the art to which this disclosure pertains.

For purposes of this specification (other than in the operating examples), unless otherwise indicated, all numbers expressing quantities and ranges of ingredients, process conditions, etc., are to be understood as modified in all instances by the term "about". Accordingly, unless indicated to the contrary, the numerical parameters set forth in this specification and attached claims are approximations that can vary depending upon the desired results sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Further, as used in this specification and the appended claims, the singular forms "a", "an" and "the" are intended to include plural referents, unless expressly and unequivocally limited to one referent.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements including that found in the measuring instrument. Also, it should be understood that any numerical range recited herein is intended to include all sub-ranges subsumed therein. For example, a range of "1 to 10" is intended to include all sub-ranges between and including the recited minimum value of 1 and the recited maximum value of 10, i.e., a range having a minimum value equal to or greater than 1 and a maximum value of equal to or less than 10. Because the disclosed numerical ranges are continuous, they include every value between the minimum and maximum values. Unless expressly indicated otherwise, the various numerical ranges specified in this application are approximations.

In the following specification and the claims, a number of terms are referenced that have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

As used herein, the term "elongate" or "elongated" is defined as something that is longer than it is wide. In other words, the width is smaller than its length.

As used herein, the term "circular" is defined as an object having a shape of a circle, i.e., an object having a simple closed shape. It is the set of points in a plane that are at a given distance from a given point, the center; equivalently it is the curve traced out by a point that moves in a plane so that its distance from a given point is constant. The distance between any of the points and the center is called the radius.

As used herein, "tapered surfaces" is defined as any two surfaces that are not parallel to each other, i.e., form a non-zero relative angle.

Figure 5:
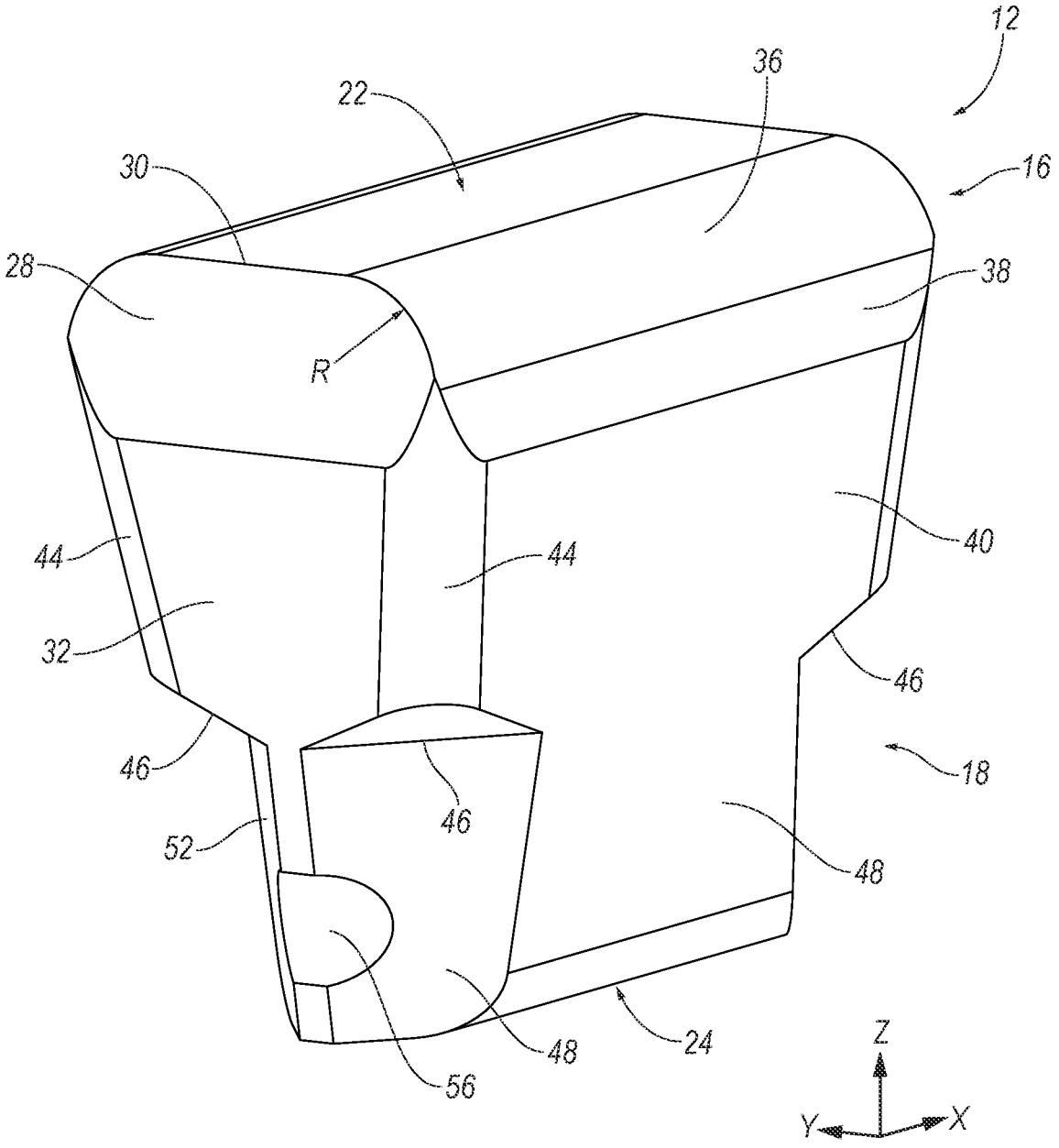
FIG. 5 is a front perspective view of the cutter tooth according to an embodiment of the disclosure.
Figure 6:
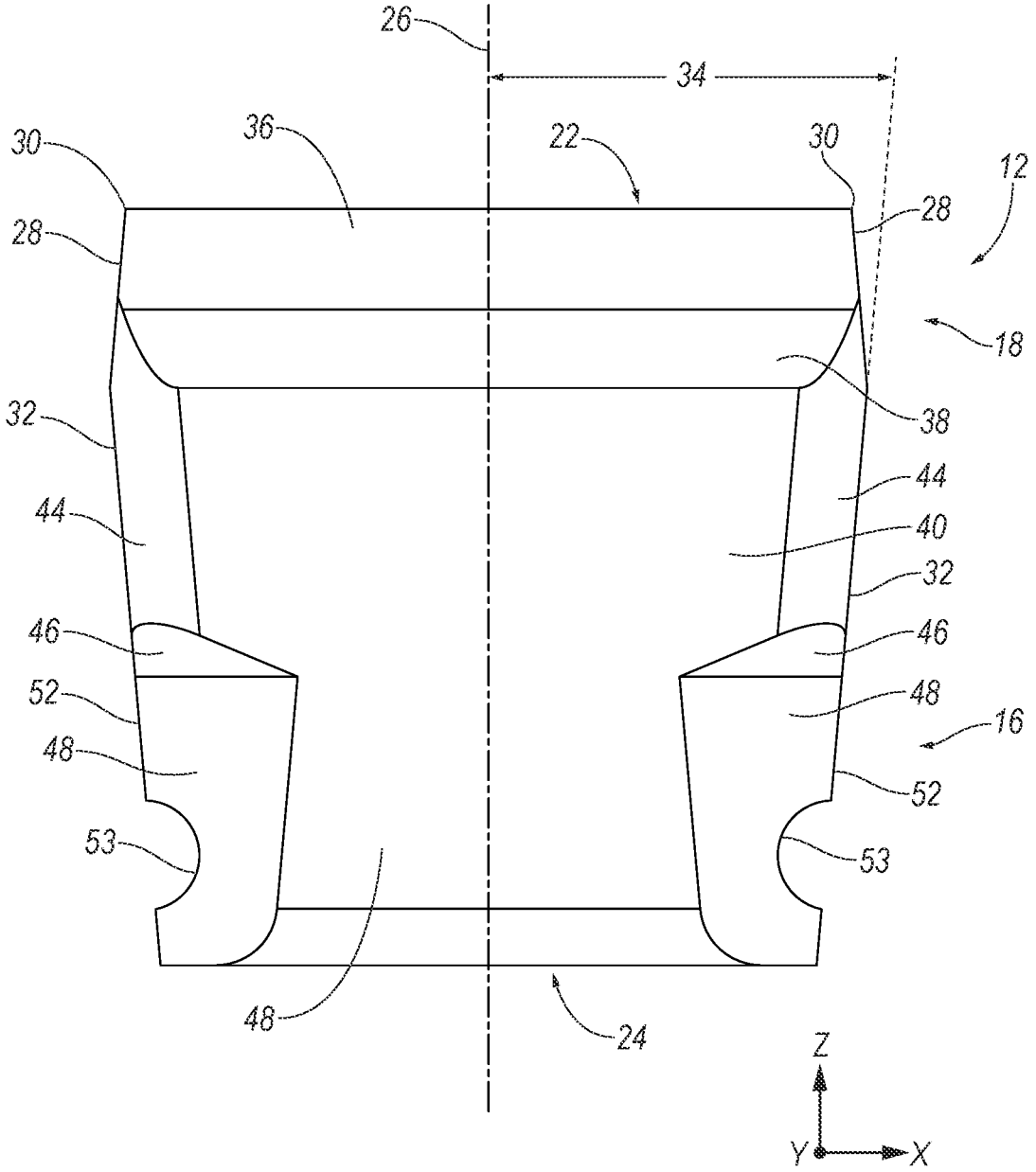
FIG. 6 is a side view of the cutter tooth of FIG. 5.
Figure 7:
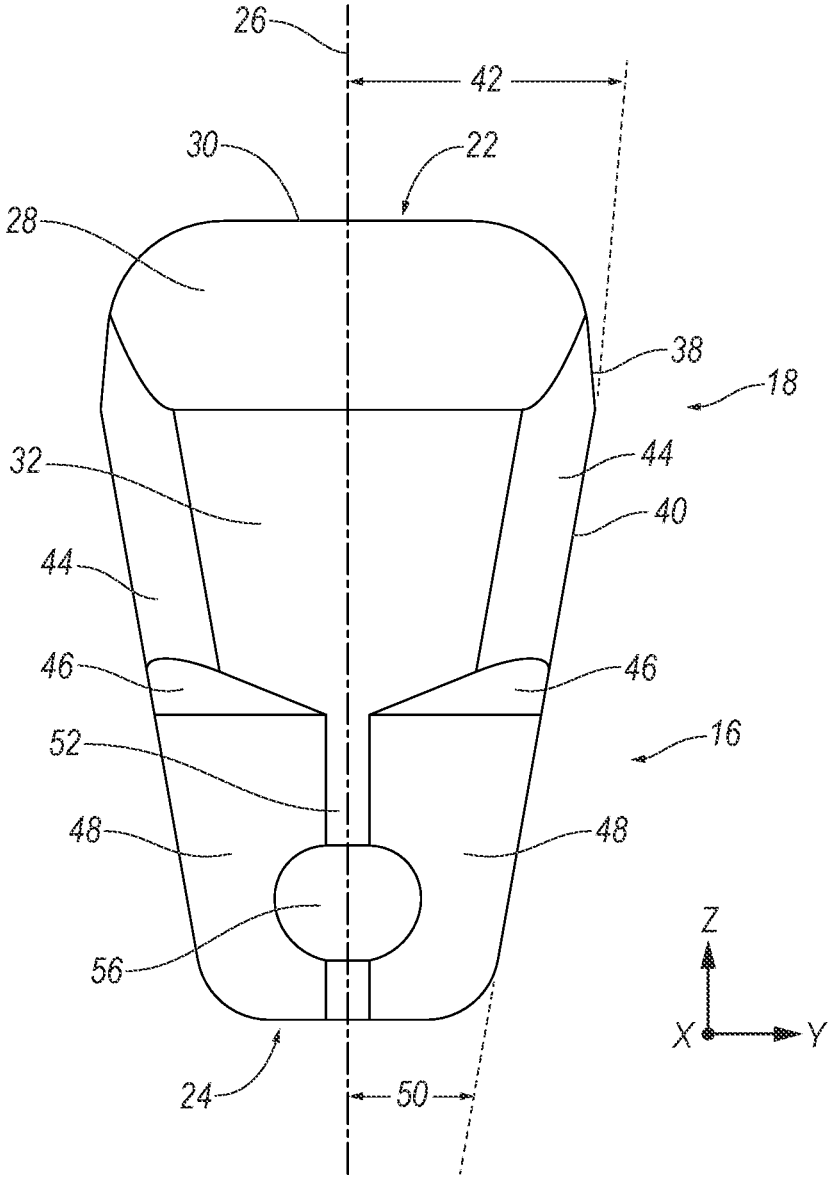
FIG. 7 is a front view of the cutter tooth of FIG. 5.

Referring now to FIGS. 5-7, the cutter tooth 12 has a top surface 22 and a bottom surface 24 opposite the top surface 22. The cutting portion 16 extends from the top surface 22 and the shank portion 18 extends from the bottom surface 24. The cutter tooth 12 has a central, vertical axis 26 (i.e., in the z-direction) extending between the top surface 22 and the bottom surface 24.

The cutting portion 16 of the cutter tooth 12 includes a first planar front surface 28 extending from the top surface 22 that is not parallel to the central, vertical axis 26 of the cutter tooth 12. A cutting edge 30 is formed at the intersection between the first planar front surface 26 and the top surface 22. It is noted that the cutter tooth 12 is mirror symmetric about the central, vertical axis 26, and therefore the cutter tooth 12 has two identical first planar front surfaces 28 and two identical cutting edges 30 on opposite sides of the cutter tooth 12, as shown in FIG. 6. The cutting portion 16 also includes a second planar front surface 32 extending from the first planar front surface 28 to the shank portion 18. However, unlike the first planar front surface 28, the second planar front surface 32 is formed at an angle 34 with respect to the vertical axis 26, as shown in FIG. 6. The angle 34 can range between about 10 degrees and 30 degrees with respect to the vertical axis 26. In the illustrated embodiment, for example, the angle 34 is about 15 degrees.

The cutting portion 16 of the cutter tooth 12 also includes a convex-shaped side surface 36 formed with a radius of curvature, R, extending from the top surface 22. A first planar side surface 38 extends from the convex-shaped side surface 36 to a second planar side surface 40 extending from the first planar side surface 38 to the shank portion 18 of the cutter tooth 12. In the illustrated embodiment, the first planar side surface 38 is substantially parallel to the vertical axis 26, and the second planar side surface 40 is formed at an angle 42 with respect to the vertical axis 26, as shown in FIG. 7. The angle 42 can range between about 10 degrees and about 30 degrees with respect to the central, vertical axis 26. In the illustrated embodiment, for example, the angle 42 is substantially identical to the angle 34 and is equal to about 15 degrees. However, it will be appreciated that the angle 42 can be different than the angle 34.

A convex-shaped corner surface 44 connects the first planar front surface 28 with the first planar side surface 38, and also connects the second planar front surface 32 with the second planar side surface 40. The cutting portion 16 may also include a plurality of overhang surfaces 46 extending between the second planar front surface 32, the convex-shaped corner surface 44 and the second planar side surface 40 and the shank portion 18 of the cutter tooth 12. The overhang surfaces 46 act as a stop to prevent unwanted vertical movement of the cutter tooth 12 when mounted in the cutter tooth holder 14.

In one aspect, the shank portion 18 of the cutter tooth 12 has a plurality of tapered surfaces 48 formed at an angle 50 with respect to the central, vertical axis 26 of the cutter tooth 12, as shown in FIG. 7. The angle 50 can range between about 10 degrees and about 30 degrees with respect to the central, vertical axis 26. In the illustrated embodiment, for example, the angle 50 is approximately equal to the angle 42 of the second planar side surface 40 and is equal to about 15 degrees. The tapered surfaces 48 on the front of the cutter tooth 12 are tapered towards each other such that the width of the cutter tooth 12 is largest proximate the top surface 22 and narrowest proximate the bottom surface 24 when viewed from the front, as shown in FIG. 7. Similarly, the second side surface 40 and the tapered surfaces 48 on the sides of the cutter tooth 12 are tapered towards each other such that the width of the cutter tooth 12 is largest proximate the top surface 22 and narrowest proximate the bottom surface 24 when viewed from the side of the cutter tooth 12, as shown in FIG. 6.

A web 52 separates two tapered surfaces 48 on opposite ends of the cutter tooth 12 (only one end can be seen in FIG. 7). It is noted that the second planar side surface 40 extends to the bottom surface 24 of the cutter tooth, and therefore forms a portion of the shank portion 18 of the cutter tooth 12. Specifically, the angle 42 of the second planar side surface 40 forms another tapered surface 48 of the shank portion 18 with respect to the vertical axis 26. Thus, in the illustrated embodiment, the shank portion 18 of the cutter tooth 12 has a total of 6 tapered surfaces 48 (i.e., 4 front tapered surfaces and 2 side tapered surfaces) with respect to the vertical axis 26. The shank portion 18 also includes a pair of retainer grooves 53 for accommodating a retainer, roll pin, tension pin, spring pin, fastener, and the like (not shown) for retaining the cutter tooth 12 within the cutter tooth holder 14.

Referring now to FIGS. 8-12, the cutter tooth holder 14 has a top surface 54 and a bottom surface 56 opposite the top surface 54. The cutter tooth holder 14 has a central, vertical axis 58 (i.e., in the z-direction) extending between the top surface 54 and the bottom surface 56. The top surface 54 and the bottom surface 56 are substantially planar and is generally polygonal in shape.

Figure 12:
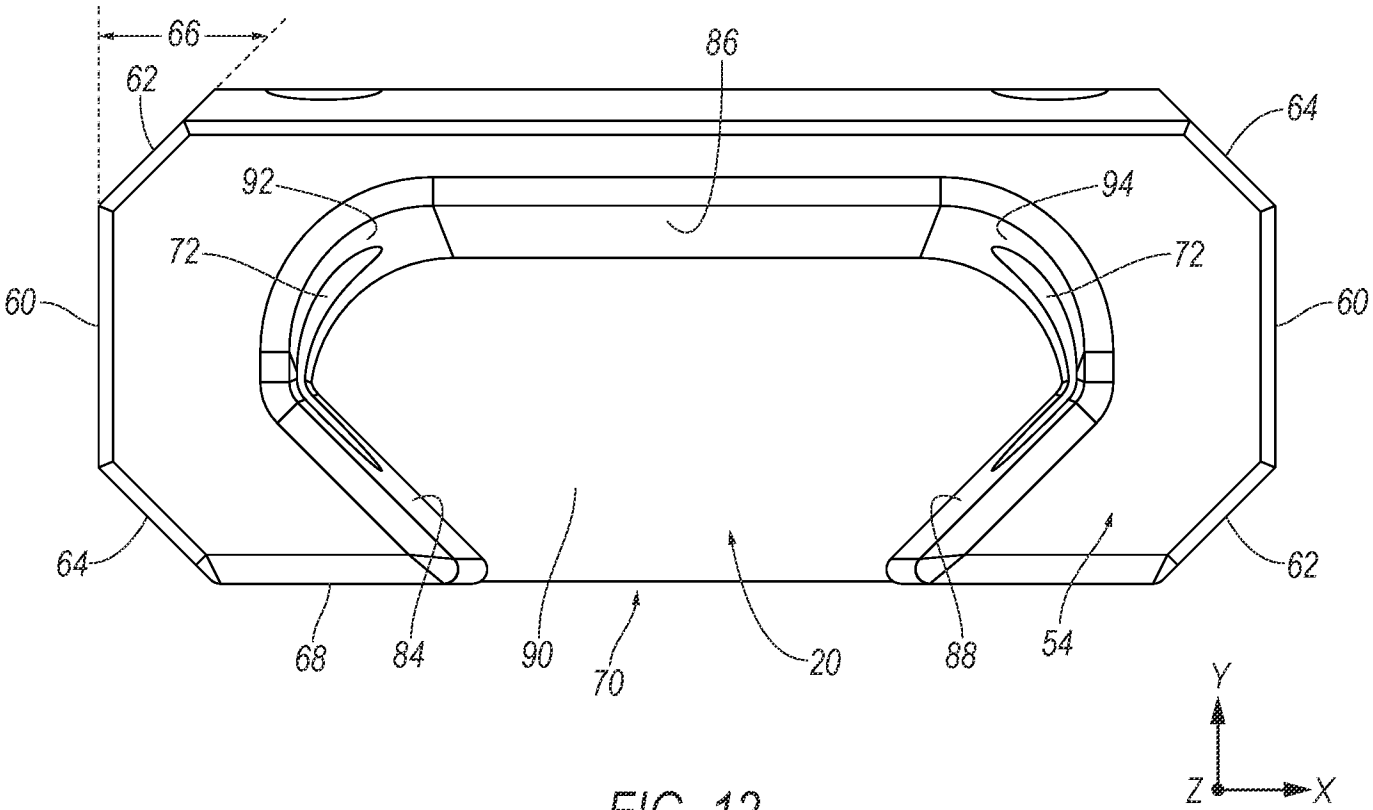
FIG. 12 is a top view of the cutter tooth holder of FIG. 8.

The cutter tooth holder 14 includes a central planar front surface 60 extending entirely from the top surface 54 to the bottom surface 56 and is substantially parallel to the central, vertical axis 58 of the cutter tooth holder 14. The central planar front surface 60 is disposed between a pair of angled front surfaces 62, 64 that also extend entirely from the top surface 54 to the bottom surface 56 of the cutter tooth holder 14. As shown in FIG. 12, each angled front surface 62, 64 forms an angle 66 with respect to the central planar front surface 60. In one embodiment, the angle 66 can be in the range between about 30 degrees and about 60 degrees. For example, in the illustrated embodiment, the angle 66 is about 45 degrees. It is noted that the cutter tooth holder 14 is mirror symmetric about the central, vertical axis 58, and therefore the cutter tooth holder 14 has two identical central planar front surfaces 60 and two identical angled front surfaces 62, 64 on opposite sides of the cutter tooth holder 14, as shown in FIG. 12.

The cutter tooth holder 14 also includes a first planar side surface 68 with a centrally located opening 70 for cleaning the cutter tooth 12 and for providing additional clearance in the lacing pattern mounting the cutting tooth assembly 10 to an excavating tool, such as a core barrel frame, and the like (not shown). The first planar side surface 68 has a pair of retainer apertures 72 extending entirely through the cutter tooth holder 14. Each retainer aperture 72 is capable of receiving a retainer, roll pin, tension pin, spring pin, fastener, and the like (not shown) for securing the cutting tooth 12 within the pocket 20 of the cutter tooth holder 14. It is noted that the retainer grooves 53 of the cutter tooth 12 is substantially aligned with the retainer apertures 72 of the cutter tooth holder 14 when the cutter tooth 12 is properly mounted within the pocket 20 of the cutter tooth holder 14 to allow a retainer, roll pin, tension pin, spring pin, fastener, and the like (not shown) to be received within the retainer apertures 72 of the cutter tooth holder 14.

Figure 9:
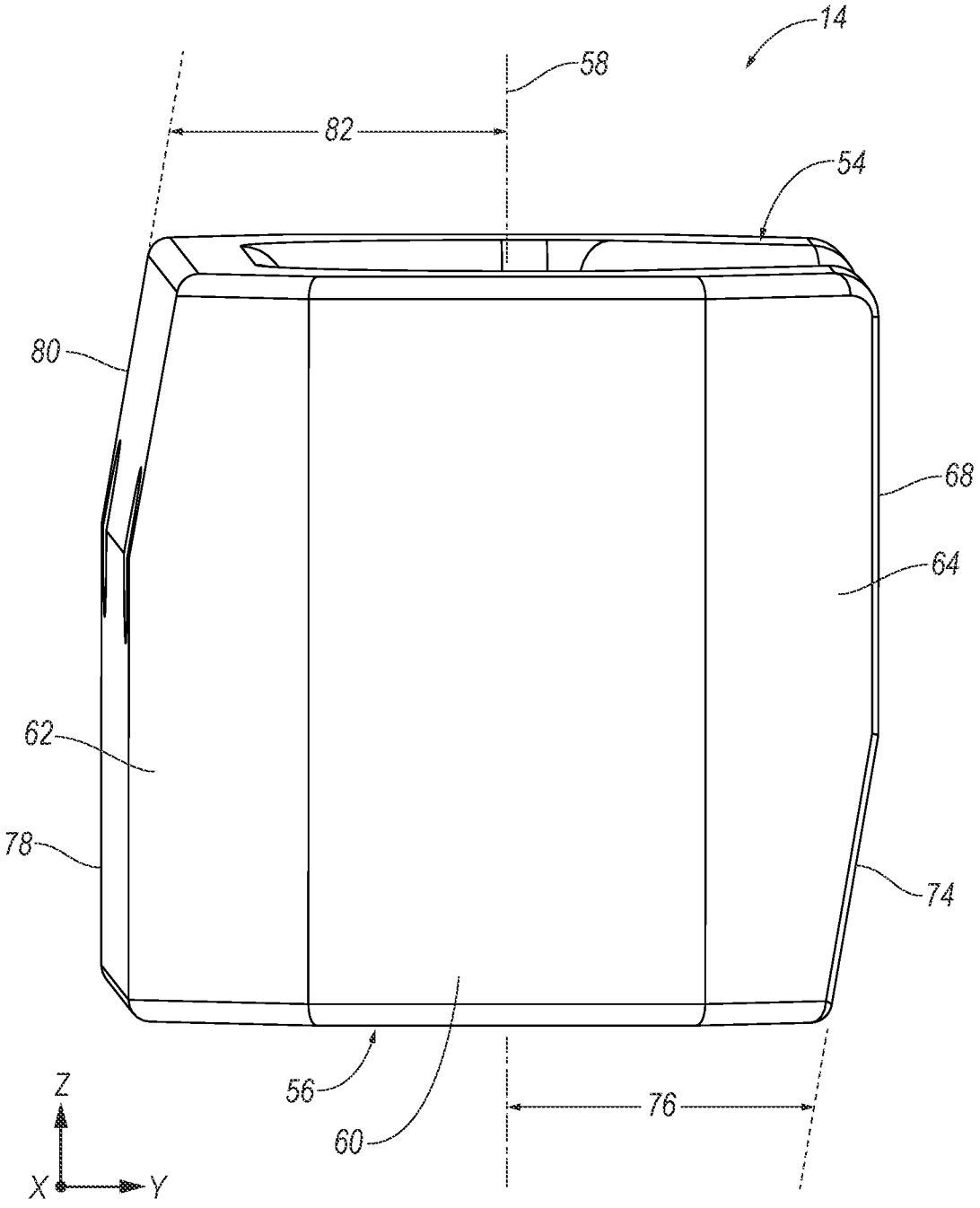
FIG. 9 is a front view of the cutter tooth holder of FIG. 8.
Figure 10:
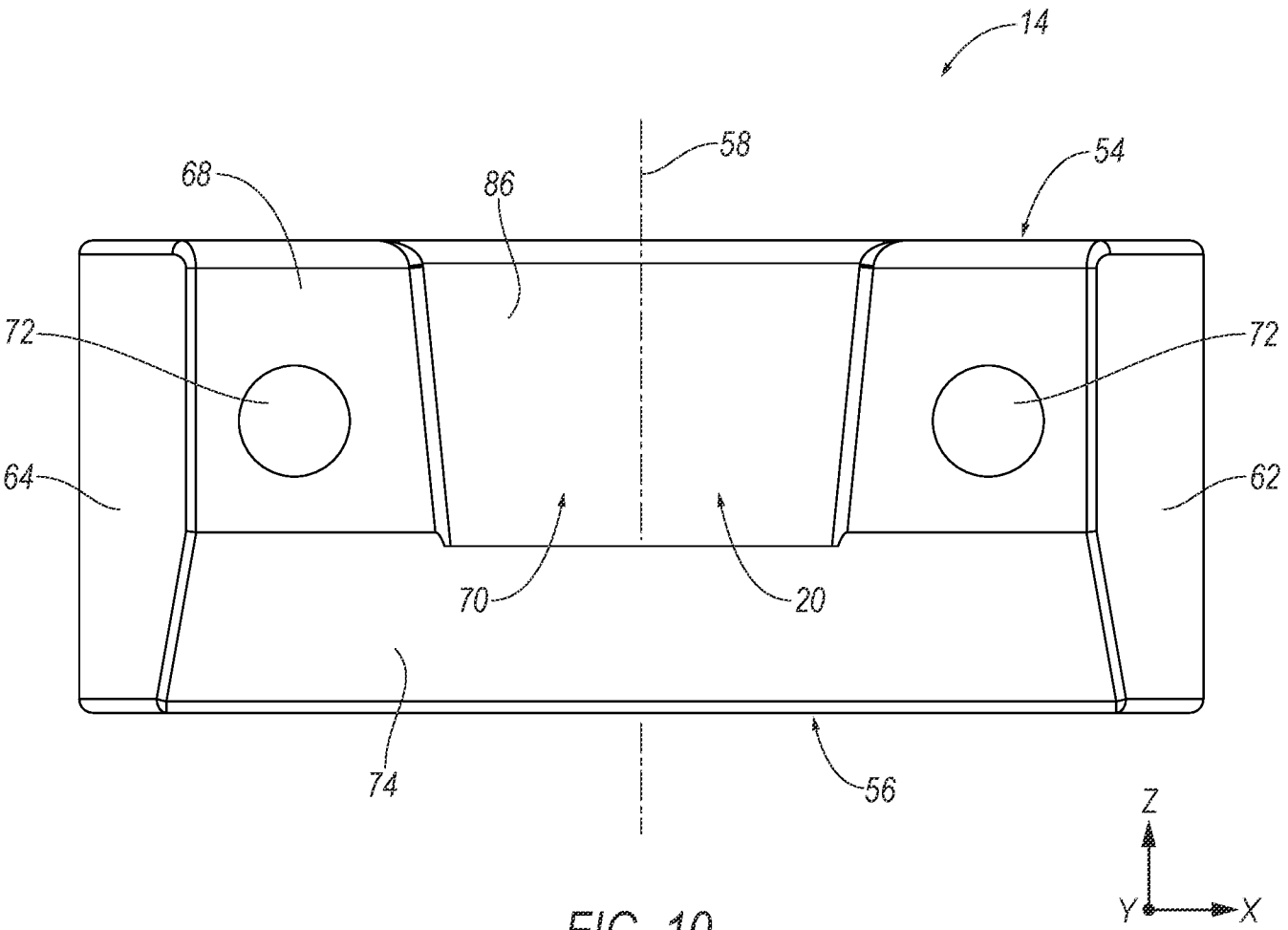
FIG. 10 is a side view of the cutter tooth holder of FIG. 8.

The first planar side surface 68 extends from the top surface 54 to a second planar side surface 74. The second planar side surface 74 is formed at an angle 76 with respect to the central, vertical axis 58 (and also the first planar side surface 68) of the cutter tooth holder 14, as shown in FIG. 9. The angled second planar side surface 74 acts as a guide surface for aligning the cutter tooth holder 14 with the desired lean angle (i.e., lean orientation) when mounting the cutter tooth assembly 10 to a rotating tool, such as a frame of a core barrel, and the like (not shown). This can be achieved by mounting the cutter tooth assembly 10 on the rotation tool such that the second planar side surface 74 is substantially vertically aligned. The angle 76 can be in the range between about 5 degrees and about 15 degrees. For example, in the illustrated embodiment, the angle 76 is about 10 degrees.

Figure 11:
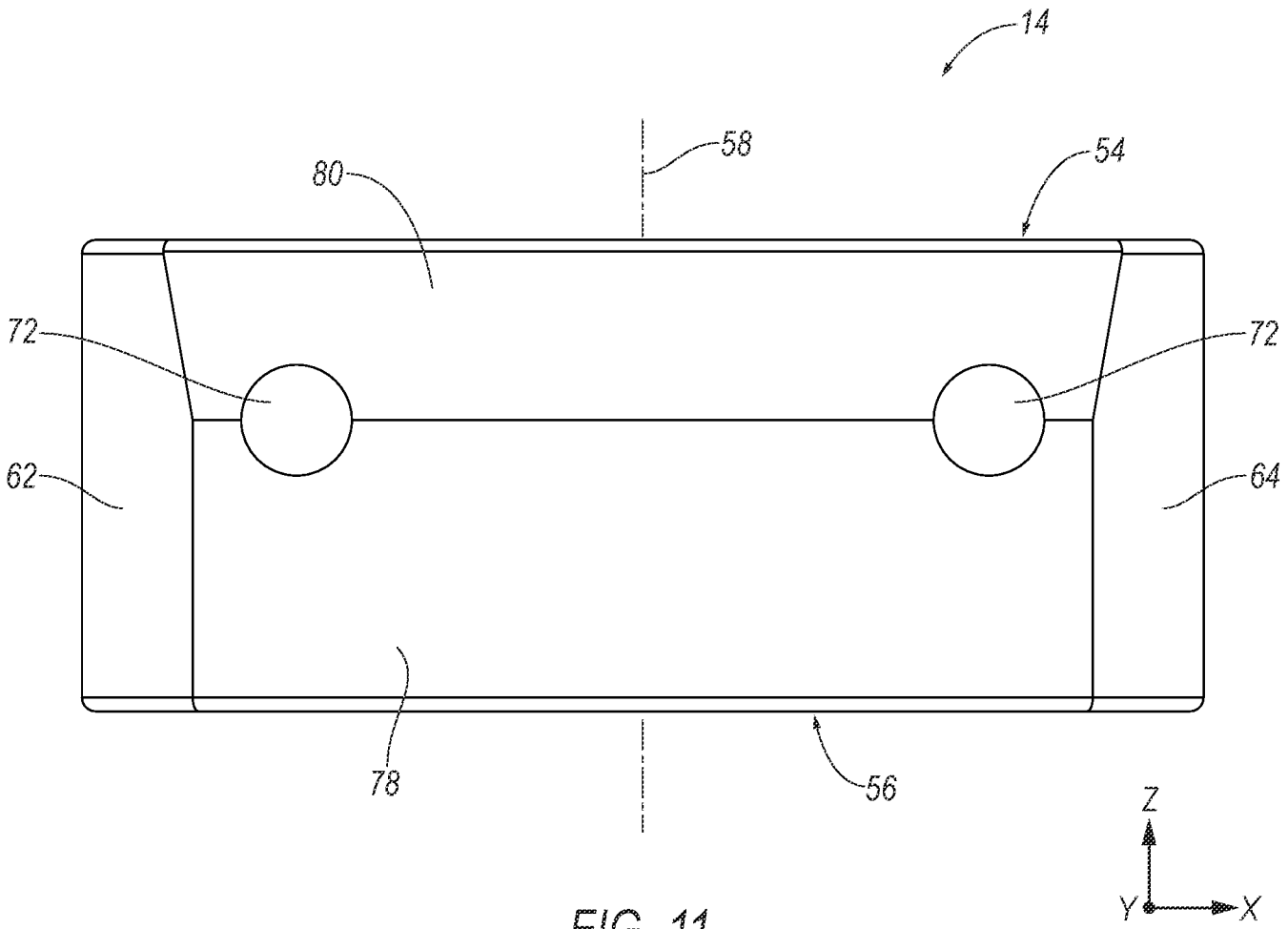
FIG. 11 is another side view of the cutter tooth holder of FIG. 8.

As shown in FIG. 11, the opposite side of the cutter tooth holder 14 includes a third planar side surface 78 and a fourth planar side surface 80 formed at an angle 82 with respect to the central, vertical axis 58 (and also the third planar side surface 78) of the cutter tooth holder 14. In the illustrated embodiment, the angle 82 is substantially identical to the angle 76 formed by the second planar side surface 74 on the opposite side of the cutter tooth holder 14. However, the angle 82 can be different than the angle 76. It is noted that the third and fourth planar side surfaces 78, 80 do not include the opening 70 to provide structural strength for the cutter tooth holder 14.

In one aspect, the pocket 20 is formed with a plurality of tapered side walls 84, 86, 88 and a bottom wall 90 extending between each of the side walls 84, 86, 88. Specifically, each tapered side wall 84, 86, 88 tapers inwardly from the top surface 54 to the bottom wall 90 of the pocket 20. In other words, the pocket 20 has the largest cross-sectional area proximate the top surface 54 and the smallest cross-sectional area proximate the bottom wall 90. A corner radius 92 connects the tapered side wall 84 with the tapered side wall 86, and another corner radius 94 connects the tapered side wall 86 with the tapered side wall 88.

Figure 8:
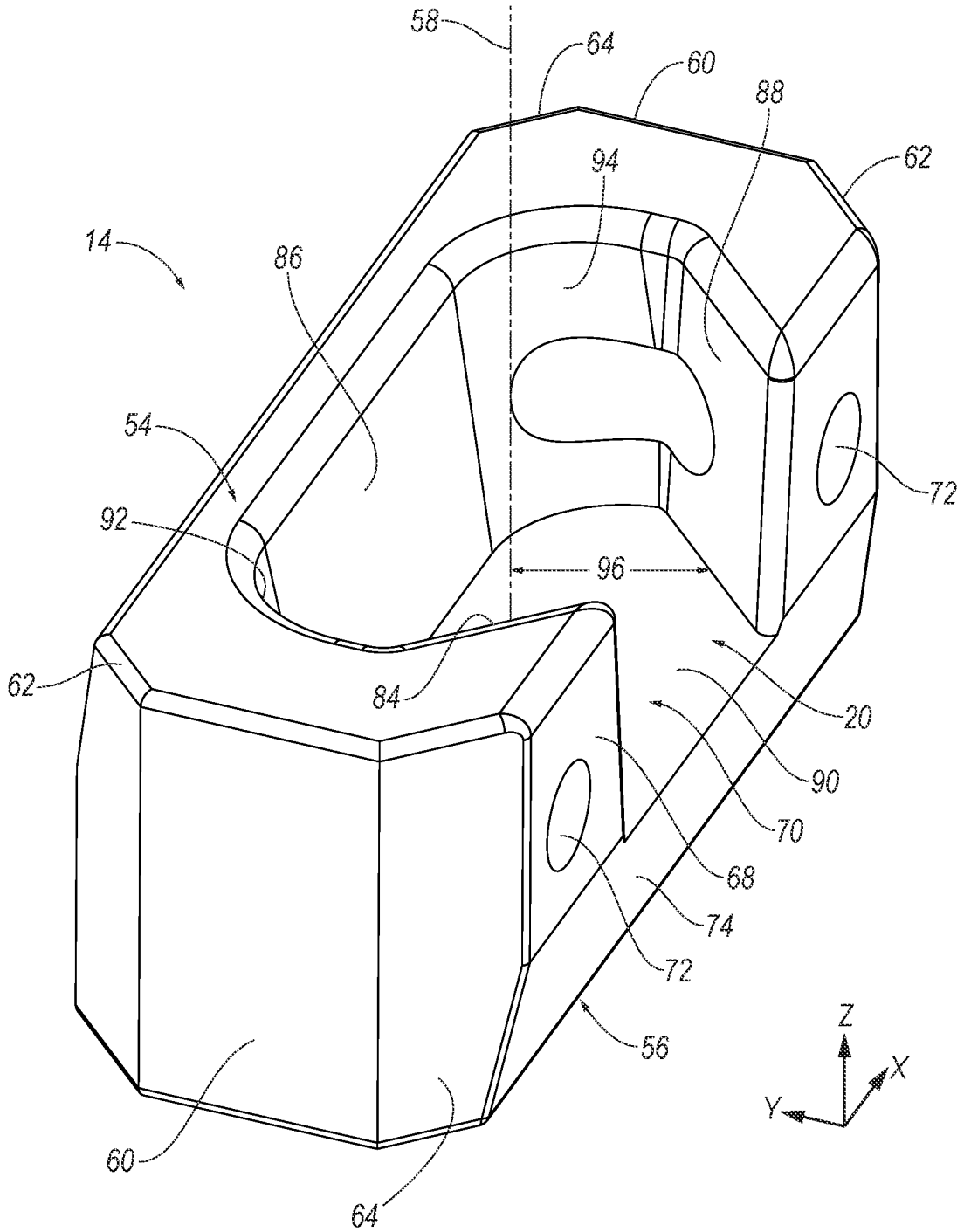
FIG. 8 is a top perspective view of the cutter tooth holder according to an embodiment of the invention.

Each tapered side wall 84, 86, 88 forms an angle 96 with respect to the central, vertical axis 56 of the cutter tooth holder 14, as shown in FIG. 8. In one embodiment, the angle 96 formed by the plurality of tapered side walls 84, 86, 88 of the pocket 20 is approximately equal to the angle 50 formed by the plurality of tapered surfaces 48 of the shank portion 18 of the cutter tooth 12 such that the plurality of tapered surfaces 48 of the cutter tooth 12 cooperate with the plurality of tapered side walls 84, 86, 88 of the pocket 20. In the illustrated embodiment, the pocket 20 of the cutter tooth holder 14 has a total of 3 tapered side walls 84, 86, 88 and, as mentioned above, the cutter tooth 12 has a total of 6 tapered surfaces 48. Thus, the cutter tooth 12 has twice as many tapered surfaces as the cutter tooth holder 14. In addition, the pocket 20 of the cutter tooth holder 14 provide contact at three different locations with the cutter tooth 12 to firmly hold the cutter tooth 12 within the pocket 20.

In another embodiment, the angle 96 formed by the plurality of tapered side walls 84, 86, 88 is not equal to the angle 50 formed by the plurality of tapered surface 48 of the cutter tooth 12. In this embodiment, an interference fit may exist between the cutter tooth 12 and the cutter tooth holder 14 when the cutter tooth 12 is mounted within the pocket 20 of the cutter tooth holder 14.

As described above, the plurality of tapered surfaces 48 of the shank portion 18 of the cutter tooth 12 allow deeper seating after wear of the cutter tooth holder 14 from repeated use to minimize tolerances between the shank portion 18 of the cutter tooth 12 and the pocket 20 of the cutter tooth holder 14 during wear of the cutter tooth assembly 10. In addition, the tapered surfaces 48 of the shank portion 18 of the cutter tooth 12 can act as weld surfaces when the cutter tooth 12 is used without the cutter tooth holder 14.

Having described presently preferred embodiments the disclosure may be otherwise embodied within the scope of the appended claims.

What is claimed is:

1. A cutter tooth assembly, comprising:

a cutter tooth having a shank portion and a cutting portion, the cutter tooth comprising a top surface, a bottom surface opposite the top surface, a first planar front surface extending from the top surface and a second planar front surface extending from the first planar front surface to the shank portion, the second planar front surface formed at an angle with respect to a central, vertical axis of the cutter tooth, the cutter tooth further comprising a convex-shaped side surface extending from the top surface, a first planar side surface extending from the convex-shaped side surface and a second planar side surface extending from the first planar side surface, the second planar side surface formed at an angle with respect to the central, vertical axis of the cutter tooth; and a cutter tooth holder having a pocket for receiving at least a portion of the shank portion of the cutter tooth, the pocket has a first tapered surface formed at an angle with respect to the central, vertical axis of the cutter tooth corresponding to the angle of the second planar front surface of the cutter tooth, and a second tapered surface formed at an angle with respect to the central, vertical axis of the cutter tooth, wherein the second planar front surface of the cutter tooth cooperates with the first tapered surface of the pocket of the cutter tooth holder, and the second planar side surface of the cutter tooth cooperates with the second tapered surface of the pocket of the cutter tooth holder, thereby minimizing tolerances between the cutter tooth and the pocket of the cutter tooth holder during wear of the cutter tooth assembly during operation.

2. The cutter tooth assembly of claim 1, wherein the angle of the second planar front surface of the cutter tooth is substantially equal to the angle of the first tapered surface of the pocket of the cutter tooth holder, and wherein the angle of the second planar side surface of the cutter tooth is substantially equal to the angle of the second tapered side surface of the pocket of the cutter tooth holder.

3. The cutter tooth assembly of claim 1, wherein the angle of the second planar front surface of the cutter tooth is different than the angle of the first tapered surface of the pocket of the cutter tooth holder, and wherein the angle of the second planar side surface of the cutter tooth is different than the angle of the second tapered side surface of the pocket of the cutter tooth holder, thereby causing an interference fit between the cutter tooth and the pocket of the cutter tooth holder.

4. The cutter tooth assembly of claim 1, wherein the angle of the second planar front surface of the cutter tooth and the angle of the second planar side surface of the cutter tooth are in a range between about 10 degrees and about 30 degrees.

5. The cutter tooth assembly according to claim 1, wherein the cutter tooth has twice as many angled surfaces as tapered surfaces of the pocket of the cutter tooth holder.

6. The cutter tooth assembly of claim 1, wherein the cutter tooth holder includes a top surface, a bottom surface opposite the top surface, and a central planar front surface extending entirely from the top surface to the bottom surface, is the central planar front surface being substantially parallel to the central, vertical axis of the cutter tooth holder.

7. The cutter tooth assembly of claim 6, wherein the central planar front surface of the cutter tooth holder is disposed between a pair of angled front surfaces extending entirely from the top surface to the bottom surface of the cutter tooth holder.

8. A cutter tooth assembly, comprising:

a cutter tooth having a shank portion and a cutting portion, the cutter tooth comprising a top surface, a bottom surface opposite the top surface, a first planar front surface extending from the top surface and a second planar front surface extending from the first planar front surface to the shank portion, the second planar front surface formed at an angle with respect to a central, vertical axis of the cutter tooth, the cutter tooth further comprising a convex-shaped side surface extending from the top surface, a first planar side surface extending from the convex-shaped side surface and a second planar side surface extending from the first planar side surface, the second planar side surface formed at an angle with respect to the central, vertical axis of the cutter tooth; and a cutter tooth holder having a pocket for receiving at least a portion of the cutter tooth, the cutter tooth holder including a first planar side surface with a centrally located opening for cleaning the cutter tooth and for providing additional clearance when mounting the cutting tooth assembly, the pocket having a first tapered surface formed at an angle with respect to the central, vertical axis of the cutter tooth corresponding to the angle of the second planar front surface of the cutter tooth, and a second tapered surface formed at an angle with respect to the central, vertical axis of the cutter tooth, wherein the second planar front surface of the cutter tooth cooperates with the first tapered surface of the pocket of the cutter tooth holder, and the second planar side surface of the cutter tooth cooperates with the second tapered surface of the pocket of the cutter tooth holder, thereby minimizing tolerances between the cutter tooth and the pocket of the cutter tooth holder during wear of the cutter tooth assembly during operation.

9. The cutter tooth assembly of claim 8, wherein the first planar side surface of the cutter tooth holder extends from a top surface to a second planar side surface, and wherein the second planar side surface is formed at an angle with respect to the central, vertical axis of the cutter tooth holder.

10. The cutter tooth assembly of claim 9, wherein the cutter tooth holder further comprises a third planar side surface extending from a bottom of the cutter tooth holder to a fourth planar side surface.

11. The cutter tooth assembly of claim 10, wherein the cutter tooth holder includes a fourth planar side surface formed at an angle with respect to the central, vertical axis of the cutter tooth holder.

12. A cutter tooth assembly, comprising:

a cutter tooth having a top surface, a bottom surface opposite the top surface, a shank portion and a cutting portion, the cutter tooth comprising a top surface, a bottom surface opposite the top surface, a first planar front surface extending from the top surface and a second planar front surface extending from the first planar front surface to the shank portion, the second planar front surface formed at an angle with respect to a central, vertical axis of the cutter tooth, the cutter tooth further comprising a convex-shaped side surface extending from the top surface, a first planar side surface extending from the convex-shaped side surface and a second planar side surface extending from the first planar side surface, the second planar side surface formed at an angle with respect to the central, vertical axis of the cutter tooth; and a cutter tooth holder having a top surface, a bottom surface opposite the top surface, and a pocket for receiving at least a portion of the cutter tooth, the pocket having a first tapered surface formed at an angle with respect to the central, vertical axis of the cutter tooth corresponding to the angle of the second planar front surface of the cutter tooth, and a second tapered surface formed at an angle with respect to the central, vertical axis of the cutter tooth, wherein the a width of the cutter tooth is largest proximate the top surface of the cutter tooth and narrowest proximate the bottom surface of the cutter tooth, wherein the pocket of the cutter tooth holder has a bottom wall, and wherein a cross-sectional area of the pocket is largest proximate the top surface of the cutter tooth holder and smallest proximate the bottom wall of the cutter tooth holder.

* * * * *